US006360465B1

(12) United States Patent
Simpson

(10) Patent No.: US 6,360,465 B1
(45) Date of Patent: Mar. 26, 2002

(54) COLLAPSIBLE SHELF SIGN

(75) Inventor: Raymond Simpson, Oakpark, IL (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/421,521

(22) Filed: Oct. 20, 1999

(51) Int. Cl.[7] ..... G09F 3/18
(52) U.S. Cl. ..... 40/638; 40/661.03; 40/661.08
(58) Field of Search ..... 40/638, 661.03, 40/661.08, 661.09, 124.05, 124.14

(56) References Cited

U.S. PATENT DOCUMENTS 4,919,377 A * 4/1990 Alexander et al. ..... 40/124.1
5,181,901 A * 1/1993 Volkert ..... 40/124.1
D338,241 S * 8/1993 Landa ..... 40/124.4
5,235,768 A * 8/1993 Eder ..... 40/488
6,012,244 A * 1/2000 Begum et al. ..... 40/661.03

* cited by examiner

*Primary Examiner*—Anthony Knight
*Assistant Examiner*—Enoch Peavey
(74) *Attorney, Agent, or Firm*—Quarles & Brady LLP

(57) ABSTRACT

The present invention discloses a collapsible shelf sign with a shelf clip for attachment to a shelf, such that the advertisement can be seen from a variety of angles.

The device comprises two main parts. One part, known in the trade as a "shouter," or the promotional section is comprised of a triangular projection, comprising two leg members and a base member, wherein the triangle face outward, with these two sides serving as promotional sides, and the third side is a base member. Attached to the base member is an attachment device for attaching the shouter to the shelf.

18 Claims, 5 Drawing Sheets

FIG. 13
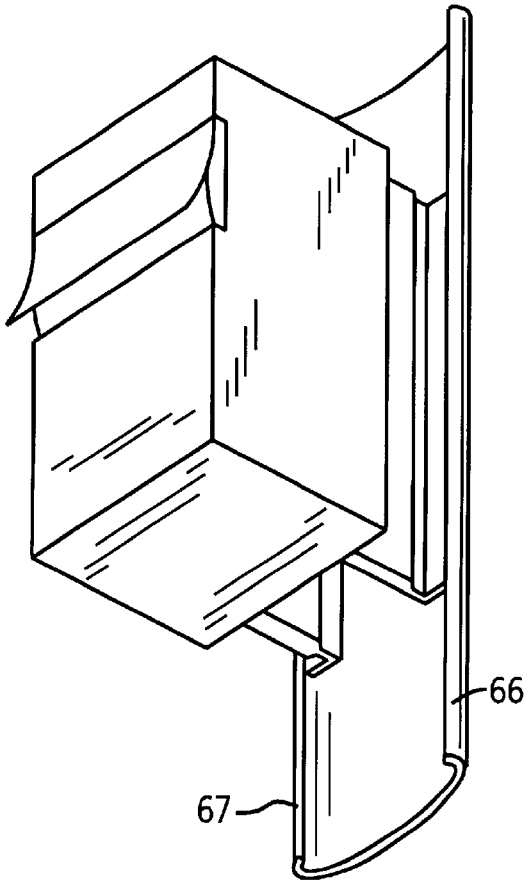
FIG. 12
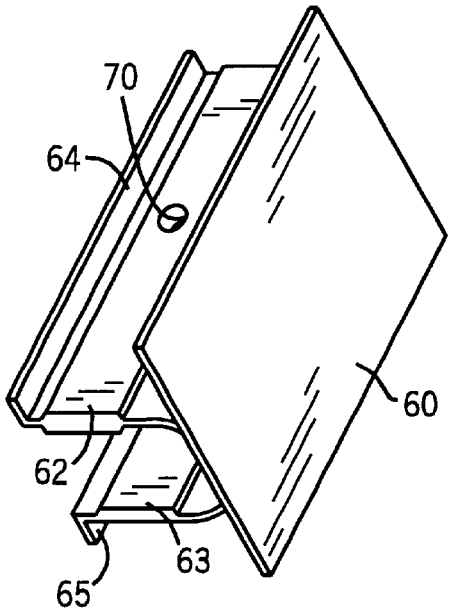
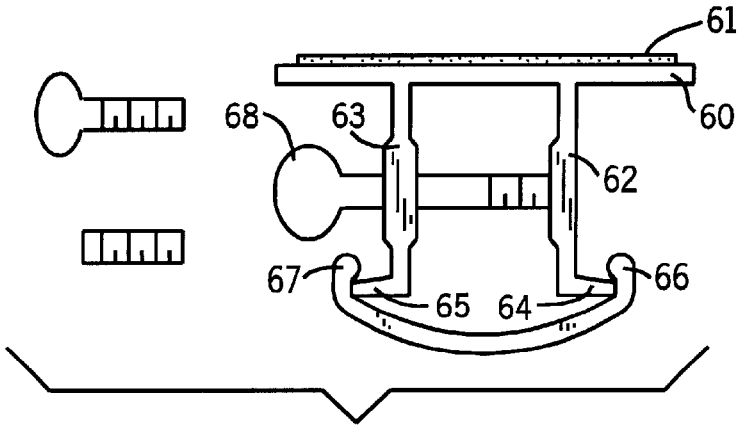
FIG. 14

COLLAPSIBLE SHELF SIGN

BACKGROUND OF THE INVENTION

1. Field of the Invention

The present invention discloses a collapsible shelf sign with a device for attaching the collapsible shelf sign to a shelf.

2. Description of the Prior Art

Over the years, a number of new products have emerged in grocery stores and other retail outlets. All of these items vie for both space on the shelf, and, equally if not more important, the attention of the consumer.

Often advertisements for items on the shelf are presented in the form of coupon dispensers.

U.S. Pat. No. 4,016,977 (Krautsack) discloses an assemblage of sheet-like items for presentation for taking on a one-by-one basis, plus means for supporting it either from a price channel or against a wall. A flat support plate of flexible material includes a pair of ears formed therein and a base section. The lower edges of the ears are spaced from the upper edge a distance greater than the vertical dimension of a price channel so the ears snap over center thereto. The rear surface of the base section carries a pressure-sensitive adhesive and a release liner. The material held by the screw may be coupons or other forms of advertisements.

U.S. Pat. No. 5,979,699 (application Ser. No. 08/999,846) (Simpson) discloses a dispenser box allowing for the removal of individual coupons without the chance of another coupon being removed at the same time. The dispenser comprises walls defining a cavity adapted to receive a stack of sheets or coupons, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

Both of these items are displayed at or near a grocery store shelf.

U.S. Pat. No. 3,471,958 (D. B. Estin) discloses a vehicle advertising device comprised of segments from a single sheet of folded material. The segments consist of at least two leg members and at least one base member, the leg members meeting at an apex angle of approximately 45 degrees, and adapted to bear advertising indicia on the external surface thereof and joining the base member at an angle of approximately 45 degrees to form a generally triangular-shaped device. The base member has interlocking means and adhesive attaching means associated therewith.

U.S. Pat. No. 3,290,809 (E. L. King) discloses a quantity-controlled amount of advertising material defined by a plurality of pieces of literature.

U.S. Pat. No. 4,832,207 (Alexander) discloses a combination of a pad installed on a holder and the method of assembly of the pad on the holder. The holder is attachable to a support and includes a flat prong for support of the sheets of paper of the pad. The prong includes a shank and an enlarged head on the shank. The head and shank form shoulders at a juncture there between.

U.S. Pat. No. 1,411,022 (Heidenreich) discloses an advertising display device having interlocking, supporting parts, the device being conveniently foldable into, and locked in, a display condition, which is self supporting and can sit upon a counter, desk, or the like.

However, none of the prior art discloses an advertising method or device which effectively juts out from the shelf in such a manner to make it visible from all angles.

SUMMARY OF THE INVENTION

The present invention discloses a shelf sign and method for advertising and/or promoting sales items on a retail store shelf such that the advertisement can be seen from a variety of angles.

The device comprises two main parts. One part, known in the trade as a "shouter," or the promotional section, is comprised of a triangular projection, with the two sides serving as leg members which are the promotional sides, and the third side serving as a base member, wherein the triangular structure faces outward, Attached to the base member is a means to attach the shouter to the shelf or shelf bracket for display. In one embodiment of the invention a poly-clip is used which can attach to a shelf bracket to secure the shouter to the shelf. In another embodiment of the invention, suction cups are used to attach the promotion section to the shelf. In yet another embodiment of the invention, adhesive means can be used to attach the shouter to another bracket clip.

BRIEF DESCRIPTION OF THE DRAWINGS

FIG. 12 shows a perspective view of another embodiment for the shelf clip;

FIG. 13 shows another perspective view of the shelf clip; and

FIG. 14 shows a side view of the shelf clip.

DESCRIPTION OF THE PREFERRED EMBODIMENT

Figure 1:
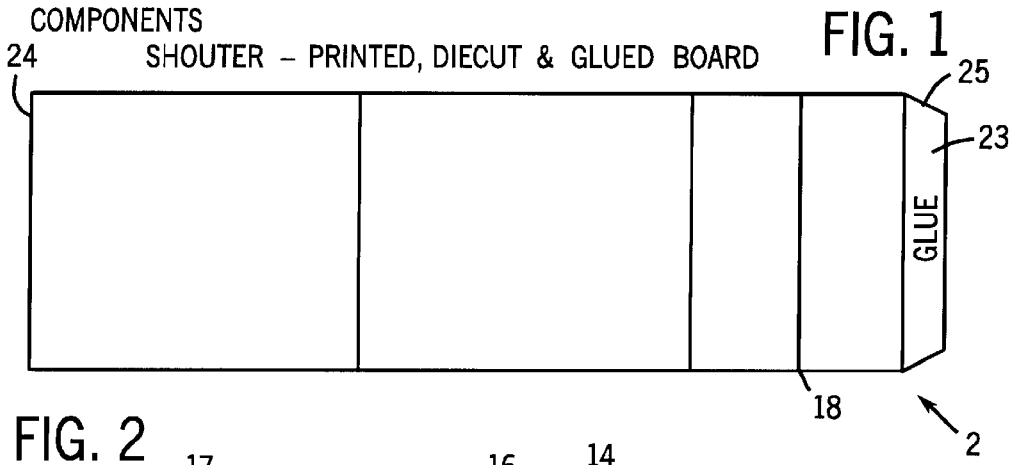
FIG. 1 is a flat overhead view of the shouter.
Figure 2:
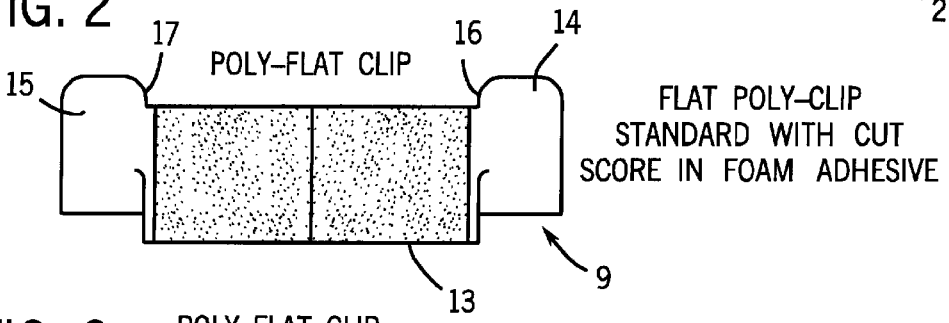
FIG. 2 is a flat overhead view of the shelf clip.
Figure 3:
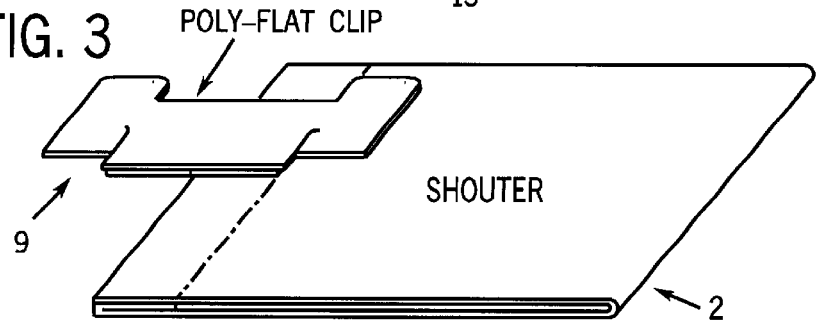
FIG. 3 is a perspective view of the shelf clip attached tot he shouter.
Figure 4:
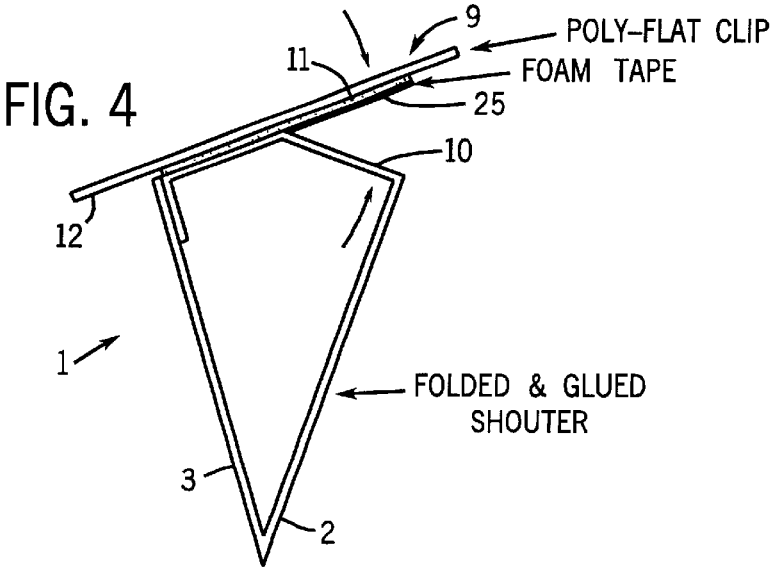
FIG. 4 is an overhead view of view of collapsible shelf sign, as the shouter is being folded into its three dimensional form.
Figure 5:
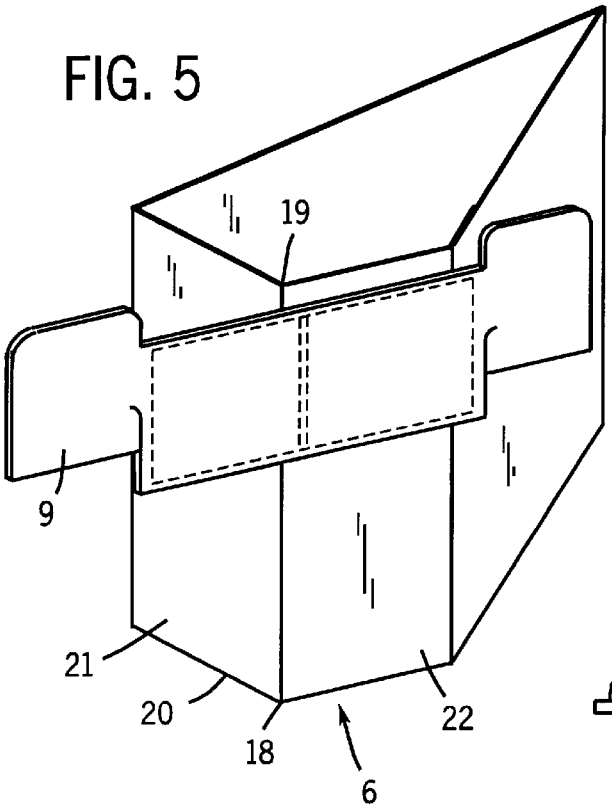
FIG. 5 is a perspective view of the back of the shelf sign as it is being folded.
Figure 6:
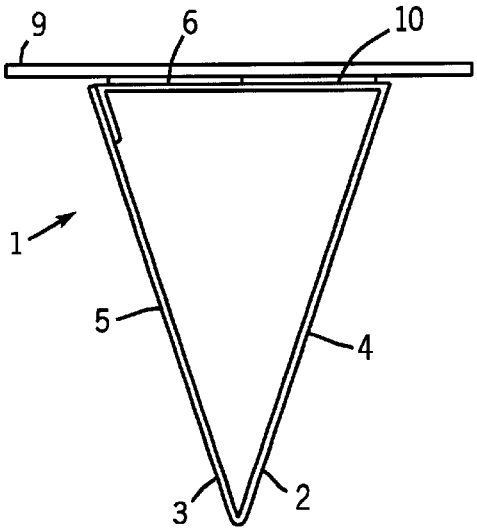
FIG. 6 is a perspective overhead view of the shelf sign.
Figure 7:
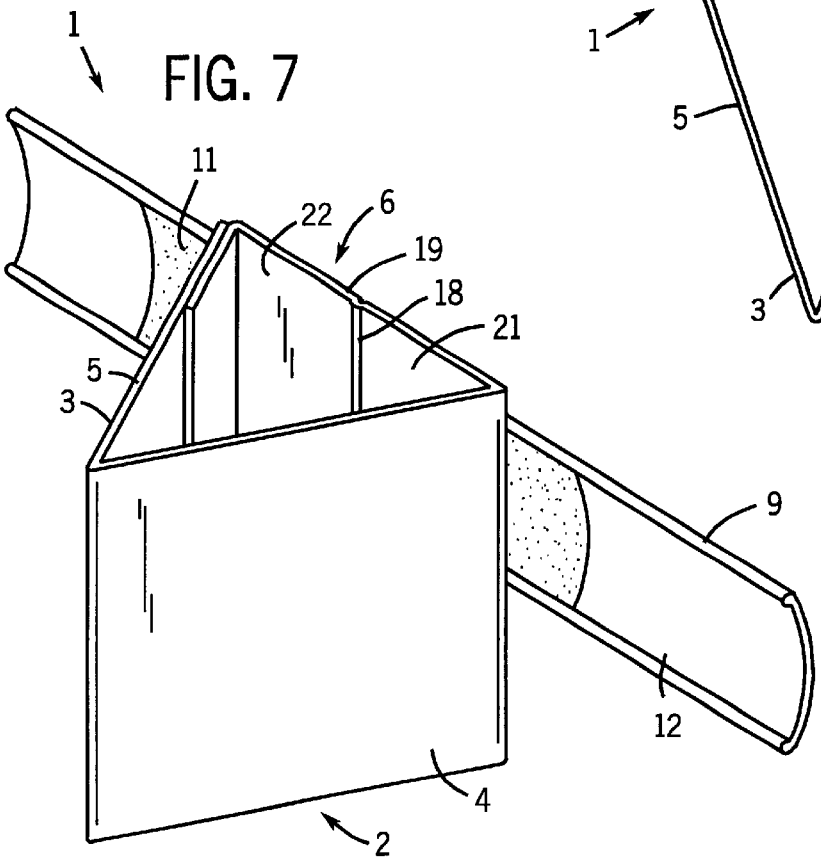
FIG. 7 is a perspective view of the shelf sign held in place to a shelf bracket.
Figure 8:
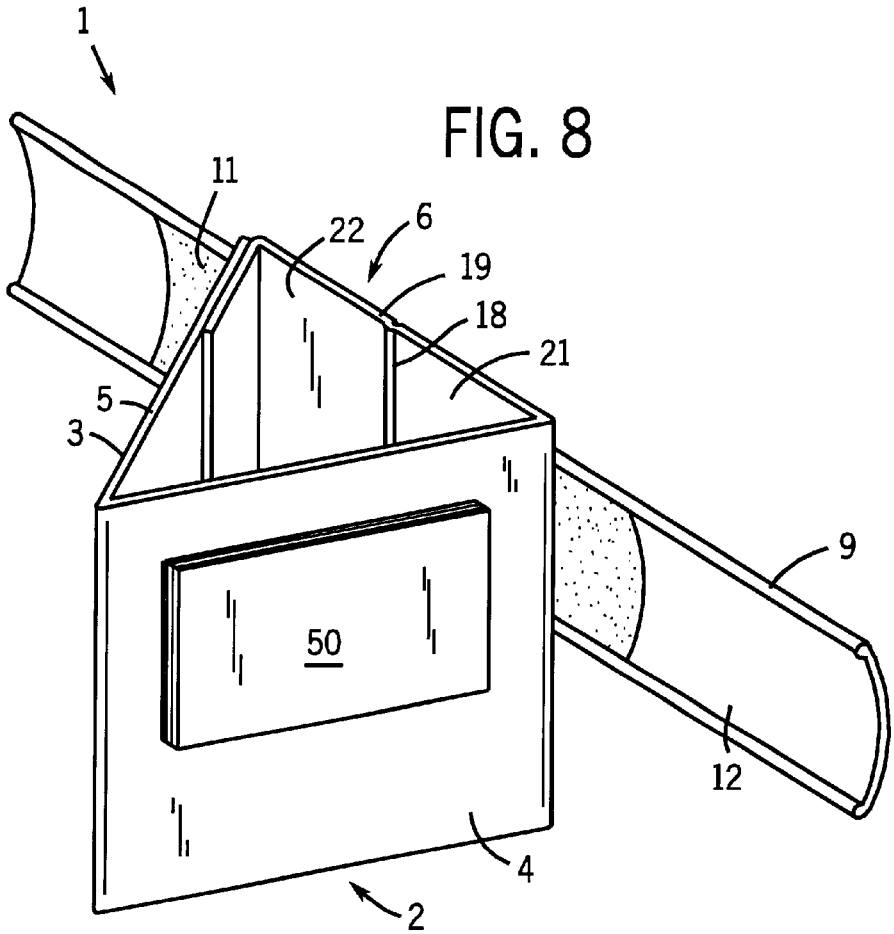
FIG. 8 shows the shouter being used for the dispensing of coupons.
Figure 9:
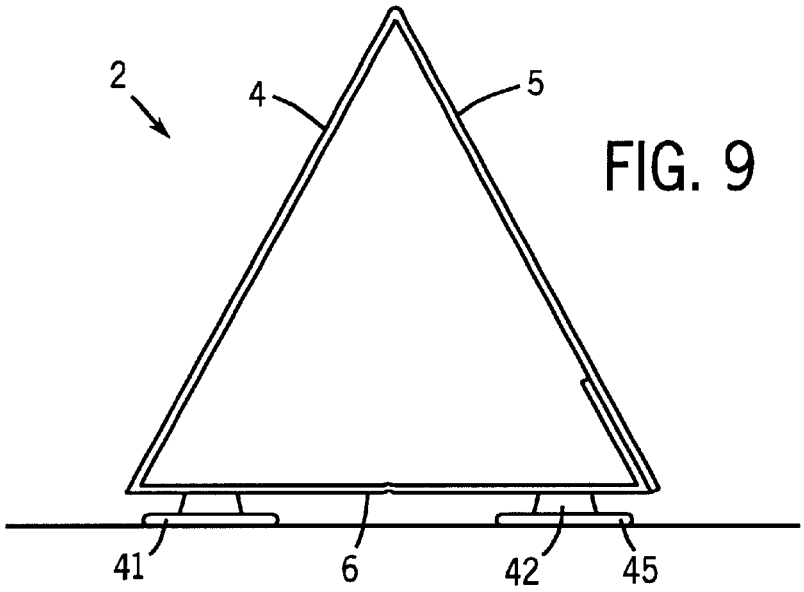
FIG. 9 shows the use of suction cups on to hold the shelf sign in place.
Figure 10:
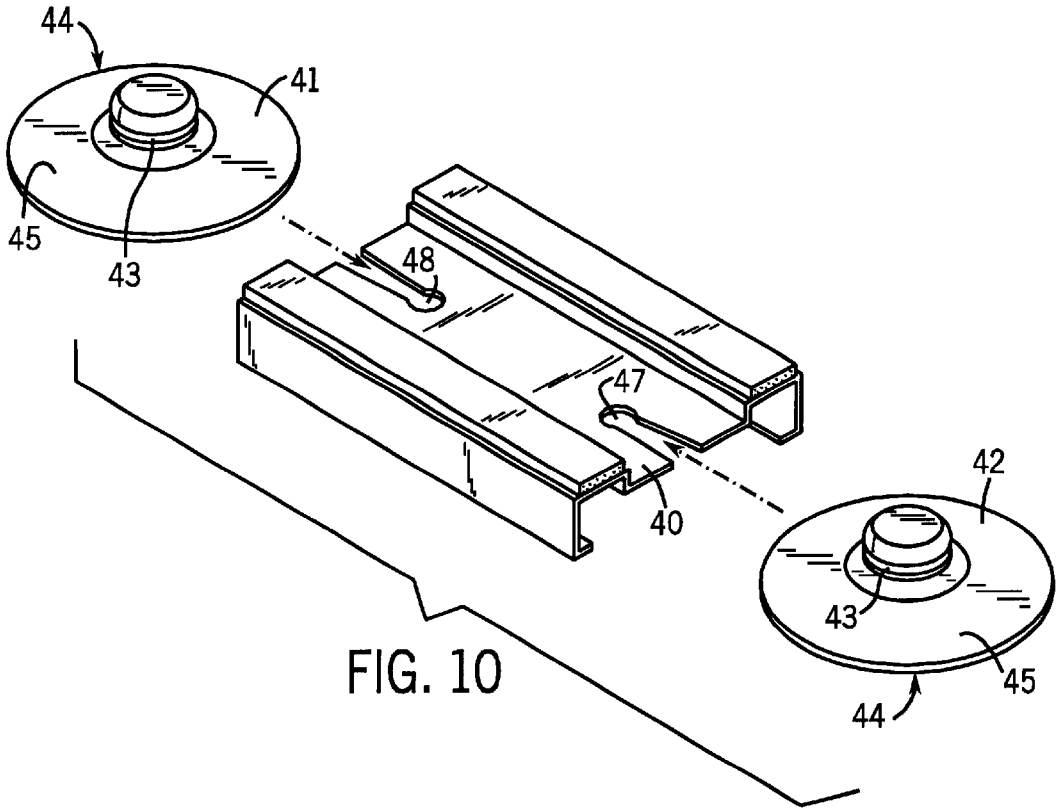
FIG. 10 shows a perspective view of a shelf clip to hold the shelf sign in place.
Figure 11:
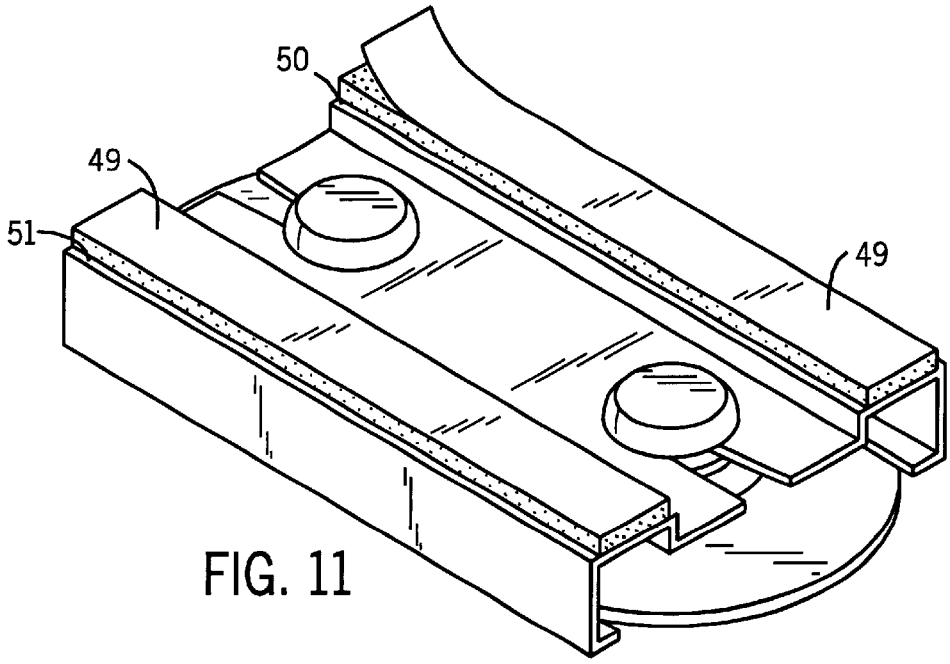
FIG. 11 shows another view of the shelf clip using suction cups to hold the shelf sign in place.

Referring to FIGS. 1–4, the shelf sign 1 comprises two primary components. One component, the shouter 2, is a triangular projection 3 comprising two sides which are leg members 4, 5 and a side being a base member 6. The two leg members 4 and 5 preferably have writing or printing on the outer sides 7, 8 of the leg members. These two sides leg members 4 and 5 serve as promotional sides. Being a triangular shaped item, the leg members are attached to the base member 6.The base member 6 preferably has a crease 18 down its center, running from the top 19 of said base member 6 to the bottom 20. Thus, in this preferred embodiment, the base member 6 has two sides 21 and 22 which are formed by the crease 18.

In a preferred embodiment of the invention, the shouter 2 is made out of cardboard, and is collapsible. More specifically, the shouter is folded along the crease 18 of the base member 6 so that it lies flat, prior to use. The shouter 2 can be made out of one piece of material, and the ends 23 and 24 of that one piece of material can be glued together, thus forming the shouter 2. One end 24 of the flat shouter 2 piece can be in the form of a tab 25. When it is desired to form the shouter 2 from its two dimensional form into its three dimensional form, the shouter 2 is folded or bent along its crease 18, thereby forming the triangular shape.

The base member 6 has, attached to it, a shelf clip 9. The shelf clip 9 preferably is attached to the outer side 10 of the base member 6 by means of an adhesive 11 on the outer side 12 of the shelf clip 9. In a preferred embodiment of the invention, the adhesive is a foam adhesive. In another preferred embodiment of the invention, the shelf clip 9 is attached to only one side 21 or 22 of the base member 6 when the shouter is in its flattened position. Hence, when the shouter 2 is folded, it is necessary to remove a paper strip or foam tape 25 from half of the adhesive 11, so that it will attach to the other side of the base member 6 when the shouter is in its three dimensional form.

Shelf clip 9 comprises a body 13 and wings 14 and 15 at each end 16 and 17 of the body 13. These wings 14 and 15 can fit into a shelf bracket, thereby securing the shouter 2 to the shelf. The shelf clip 9 is preferably made out of plastic. In another embodiment of the invention, the wings 30 and 31 are positioned on the top and bottom of the body 13 of the shelf clip 9.

The shelf clip 9 is positioned so that the sides of the shouter 2 can be seen from either side of the shopping aisle. The sides are positioned vertically, and the shelf clip 9 is positioned from side to side on the shouter 2 . Printed material may appear on the outside of either or both leg members 4, 5 of the shouter 2. In another preferred embodiment of the invention, coupons 50 may be attached by adhesive on the outside of either or both leg members 5, 6 of the shouter 2.

In another embodiment of the invention, the shelf clip 40 has at least one suction cup 41, and preferably another suction cup 42 which can attach to any flat surface. The suction cups 41 and 42 preferably have a neck 43 on top of the suction pieces 44, and a rubber flange 45. The shelf clip 40 preferably has slots 47, 48 into which to slip the neck of the suction cups. The clip 40 is affixed to the shouter 2 by an adhesive 49 attached to flat ridges 50, 51 that are part of the clip 40. In another embodiment of the invention, the suction cups 41 and 42 may be attached directly to the base member.

The shelf clip which holds the collapsible shelf sign to the shelf may be comprised of a flat surface 60 for attachment, preferably by adhesive 61 to the base member of the shelf sign. Intersecting and extending outwardly from the base member 60 and away from the shouter are two brackets 62 and 63, having, at their ends, foot-like projections 64 and 65 facing away from each other. These foot-like projections 64 and 65 fit into retaining rails 66 and 67 of a shelf. To assist in the insertion or removal of this shelf clip, a screw 68 is fitted through hole 70 in one of the two brackets 62 and 63, whereupon the tightening or loosening of the screw 68 pushes together or allows for the expansion of the two brackets, thereby allowing for the placement or removal of the device on the shelf edge.

It should be noted that any number of attachment means can be used to attach the shouter to the shelf, and as such this patent is not limited to any specific "clip" or attachment means.

This arrangement for the display of advertisements or the display of coupons has the advantage of being inexpensive and easy to manufacture. Additionally, this shelf sign is quite durable, thus reducing the amount of manpower to repair or replace the signs.

Many modifications and variations of the present invention are possible in light of the above teachings. It is, therefore, to be understood within the scope of the appended claims the invention may be protected otherwise than as specifically described.

What is claimed is:

1. A shelf sign for displaying printed matter, said shelf sign comprising;

a shouter having two leg members serving as promotional surfaces and a base member connecting the two leg members to form a triangular projection; and a shelf clip mounted to said base member and attachable to a shelf such that said shelf shouter is displayable from said shelf;

wherein said shouter can be collapsed by folding said shouter between said two leg members and along a crease in said base member.

2. The shelf sign according to claim 1, wherein said shelf clip comprises:

a body; and a wing at each end of said body, wherein said wing can fit into a shelf bracket, thereby securing the shouter to the shelf.

3. The shelf sign according to claim 2, wherein said shelf clip is comprised of plastic.

4. The shelf sign according to claim 2, wherein said shelf clip is positioned so that the sides of the shouter can be seen from either side of a shopping aisle.

5. The shelf sign according to claim 4, wherein said legs members of said shouter are positioned vertically, and wherein said shelf clip is positioned across said base member of said shouter.

6. The shelf sign according to claim 1, wherein said crease is positioned in the center of said base member from a top of said base member to a bottom of said base member, thereby forming two sides of said base member.

7. The shelf sign according to claim 6, wherein approximately one half of said shelf clip is attached to one side of said base member, such that said shelf sign may be folded.

8. The shelf sign according to claim 6, further comprising a protective strip covering one-half of said adhesive of said shelf clip, wherein approximately one half of said shelf clip is attached to one side of said base member, such that when said shouter is expanded into a triangular shape, said protective strip is removed from said one-half of said adhesive, and said adhesive of said protective strip is pressed onto the base member against which it is positioned.

9. The shelf sign according to claim 1, wherein said base member of said shouter is comprised of cardboard.

10. The shelf sign according to claim 1, wherein said shouter is made out of a singular piece of material.

11. The shelf sign according to claim 10, wherein the ends of said singular piece of material are affixed together, thus forming the shouter.

12. The shelf sign according to claim 11, wherein the ends of said singular piece of material are glued together, thus forming the shouter.

13. The shelf sign according to claim 1, wherein the shouter further comprises printing on an outside surface of at least one said leg member.

14. The shelf sign according to claim 1, further comprising removable coupons attached to at least one of said leg members of said shouter.

15. The shelf sign according to claim 1, wherein said shelf clip is a suction cup.

16. The shelf sign according to claim 1, wherein said shelf clip includes a suction cup.

17. The shelf sign according to claim 1, further comprising coupons attached to at least one of said leg members of said shouter.

18. The shelf sign according to claim 1, wherein said shelf clip comprises:

a flat surface for attachment to the base member of the shelf sign;

two brackets intersecting and extending outwardly from the base member, said brackets having, at their ends, foot-like projections facing away from each other, said foot-like projections fitting into retaining rails of a shelf;

a screw, said is fitted through said hole in one of said bracket, whereupon the tightening or loosening of the screw pushes together or allows for the expansion of the two brackets, thereby allowing for a placement or removal of the shelf clip on a shelf edge.

* * * * *